US005850982A

United States Patent [19]

Roth et al.

[11] Patent Number: 5,850,982

[45] Date of Patent: Dec. 22, 1998

[54] DEVICE FOR THE WIND UP OF A KNITTED MATERIAL WEB

[75] Inventors: Karl-Heinz Roth, Naila; Rudi Wirth, Schwarzenbach/Wald, both of Germany

[73] Assignee: Liba Maschinen Fabrik GmbH, Naila, Germany

[21] Appl. No.: 853,988

[22] Filed: May 9, 1997

[30] Foreign Application Priority Data

May 22, 1996 [DE] Germany ..... 196 20 670.7

[51] Int. Cl.[6] ..... B65H 23/198

[52] U.S. Cl. ..... 242/413.5; 242/535; 242/548; 226/190

[58] Field of Search ..... 242/413.5, 548, 242/547, 535, 534, 534.2, 541.6; 26/105; 226/190

[56] References Cited

U.S. PATENT DOCUMENTS 650,717 5/1900 Goodline ..... 26/105
4,171,107 10/1979 Kayser et al. ..... 242/548
4,343,440 8/1982 Engl ..... 242/548
4,491,283 1/1985 Pav et al. ..... 242/535
4,553,713 11/1985 Hecht et al. ..... 242/548
4,566,162 1/1986 Brands ..... 242/548

*Primary Examiner*—John M. Jillions
*Attorney, Agent, or Firm*—Frohwitter

[57] ABSTRACT

The invention relates to a device for the winding of a knitted material web which is being delivered from a warp knitting machine to a material roll by using an axial drive which is being regulated by sensors which measure the tension in the material web. For the purpose of winding a knitted elastic material, a spreader roller is arranged adjacent to the run-on site of the web onto the material roll and is held there with a constant gap. In order to maintain an essentially constant gap between the spreader roller and the material roll, the spreader roller undergoes a relative shifting along a radial guide.

7 Claims, 3 Drawing Sheets

DEVICE FOR THE WIND UP OF A KNITTED MATERIAL WEB

The invention relates to a device for the wind up of a knitted material web which is being delivered from a warp knitting machine to a material roll by using an axial drive which is regulated with regard to its numbers of rotations by means of material tension sensors.

Such a device is illustrated in its design for a ISO-Norm 864-2/07.94, page 12 under numeral 6.1.2. The axial drive in this case is an electric motor which reacts to the tension of the material web to be wound up by way of a dancer roll and it is regulated in such a manner with regard to its number of rotations to keep the tension in the material at a constant. This means that, when a preceding warp knitting machine keeps operating at the same speed, the increasing diameter of the material roll results in a regulated decrease of its rotations.

An object of the invention is to construct the device in such a manner so that the elastic knitted material can be wound up without any problems. According to the invention this is achieved by arranging a spreader roller in the neighborhood of the wind up roll at a spacing between the spreader roll and the run on site of the web on the material roll, wherein the spacing is held at a constant and its relative shifting is a result of a radial guidance.

Because of arranging a neighboring spreader roller in the vicinity of the run on site of the material web, care is taken that the delivered material web is subjected to a lateral stretching force in the sense of a lateral spreading so that the material web under the influence of the spreader roller is practically, just prior to its wind up on the material roll, that is, just prior to the run on site, spread to a constantly remaining width and is being wound up in this manner.

On the short way from its transit from the spreader roller to the material roll, there is hardly any length of material so that the material web cannot contract into itself or, especially, cannot curl up at its edges. This latter effect is well known and without further intervention results in so-called bony rolls. With this designation, an elastic material roll is being described in which a cross-section exhibits the end regions to be enlarged to thereby show a much larger diameter relative to the middle region. Such a bony web roll is a hindrance when subjected to further finishing operations.

Because of maintaining an essentially constant gap between the material roll and the spreader roller by a shifting of the material roll relative to the spreader roller through the steps taken by the inventive device, it is being achieved that over the total diameter of the material roll, when being wound up, the material web is spread out in an even manner so that independent of the diameter of the material roll, the material web is always spread to its full width when being delivered to the material roll resulting in practically an essentially cylindrical material roll.

The use of a spreader roller, when winding up an elastic knitted fabric, in combination with the winding of a knitted web is known in which the material roll is carried by two friction rollers arranged adjacent to each other with at least one of them being driven. In this type of drive of the material roll, the regulation of its rotations is not necessary because the drive is achieved with a constant rotation by means of the friction rollers which carry the material roll. The spreader roller is pre-positioned to one of the friction rollers after which the material web is guided around one of the friction rollers which then will guide the web to the material roll. In such an arrangement of the spreader roller, a considerable gap is present between the spreader roller and the run on site of the material web so that a pulling together of the material web in its cross direction cannot be excluded. Furthermore, because of the increasing diameter of the material roll and the pressure it exerts on the friction rollers, there is an inner shifting of the warps which results in a so-called moire-effect. It has been tried already to counter this effect, caused by the friction rollers when winding a material roll, by countering the force of gravity by an opposing pressure on the shaft of the material roll but this effort involves quite an expenditure. The relief of the friction rollers obtained thereby has to result in an increasing pressure on the shaft of the material roll which results in an expensive mechanism. This relief still has to put up with a necessary force of friction for the drive of the material roll so that in spite of the relief, a certain inner shifting of the warps and thereby a moire-effect cannot be avoided.

The problem created, when using friction rollers which carry the material roll, is completely eliminated by this invention because the use of a regulated axial drive for the knitted material web when being wound up under constant tension and without using any frictional forces because of the spreader roller, which has been placed especially closely to the run-on site of the web with a constant gap relative to the increasing diameter of the material roll, care is taken that the spreading effect is utilized to its fullest extent.

The device can be constructed in such a manner that in order to maintain a constant gap between the material roll and the spreader roller, the latter can be guided radially outwardly when the diameter of the material roll increases. However it is also possible to guide the material roll away from the spreader roller when its diameter increases. In both cases, it involves a relative shifting of the material roll relative to the spreader roller, namely, along a radial guide so that independently of any respective diameters of the material roll, the spreader roller is kept closely to the run-on site of the material web so that the above mentioned short transit of the web between the material roll and the spreader roller is realized.

In order to give the spreader roller the necessary space for movement relative to the ever increasing diameter of the material roll, the spreader roller should be supported at its ends by pivot arms whose positions are chosen in such a manner that the spreader roller when pivoting results in a nearly straight radial movement relative to the material roll. The spreader roller thereby undergoes a movement along an arc of a circle which however with a sufficient length of the pivot arms will deviate from the linear so little that it is negligible to keep the desired position for the spreader roller with a constant gap relative to the material roll. The preservation of the gap of the spreader roller can be the result of the use of known distance sensors such as, for example, based on reflections from either sound or-light rays.

In order to adapt the shifting of the material roll to its ever increasing diameter, the shaft of the material roll for this purpose is supported in a vertical linear guide which is normal to its axis so that the shaft of the material roll whose diameter is ever increasing is steadily distancing itself from the spreader roller only under the condition that the distance between the material roll and the spreader roller is maintained essentially the same. Also in this case, the maintaining of the gap between the material roll and the spreader roller is the result of known distance sensors.

It is practical to arrange deviation rollers up stream of the spreader roller so that after several deviations the material web will be relaxed. Under the influence of elastic threads having been knitted into the knitted fabric, there is a tendency, immediately after the knitting process, that these elastic threads exert a strong inner tension in the cross direction of the web which results in a shrinking of the material web crosswise on its way to the material roll. When this shrinking of the knitted material web is not checked, then the knitted material keeps its inner tension, especially in its cross direction, which influences the final wind-up of the material web and results in an unevenness in the material roll.

The spreader roller itself is in a commonly known manner provided with a screw-like rib on its circumference, namely, with two opposing pitches so that when rotating the spreader roller in a certain direction, a tendency of divergent forces will result which thereby press against the knitted web and spread the same outwardly. In order to obtain a high spreading effect, the spreader roller is correspondingly provided with a high circumferential speed which is at least ten times the speed of the transport speed of the material web so that the spreader roller speed substantially exceeds the relative speed of the transport speed of the web material.

The Figures illustrate an embodiment of the invention which will be explained in detail below.

DETAILED DESCRIPTION OF THE DRAWINGS

Figure 1:
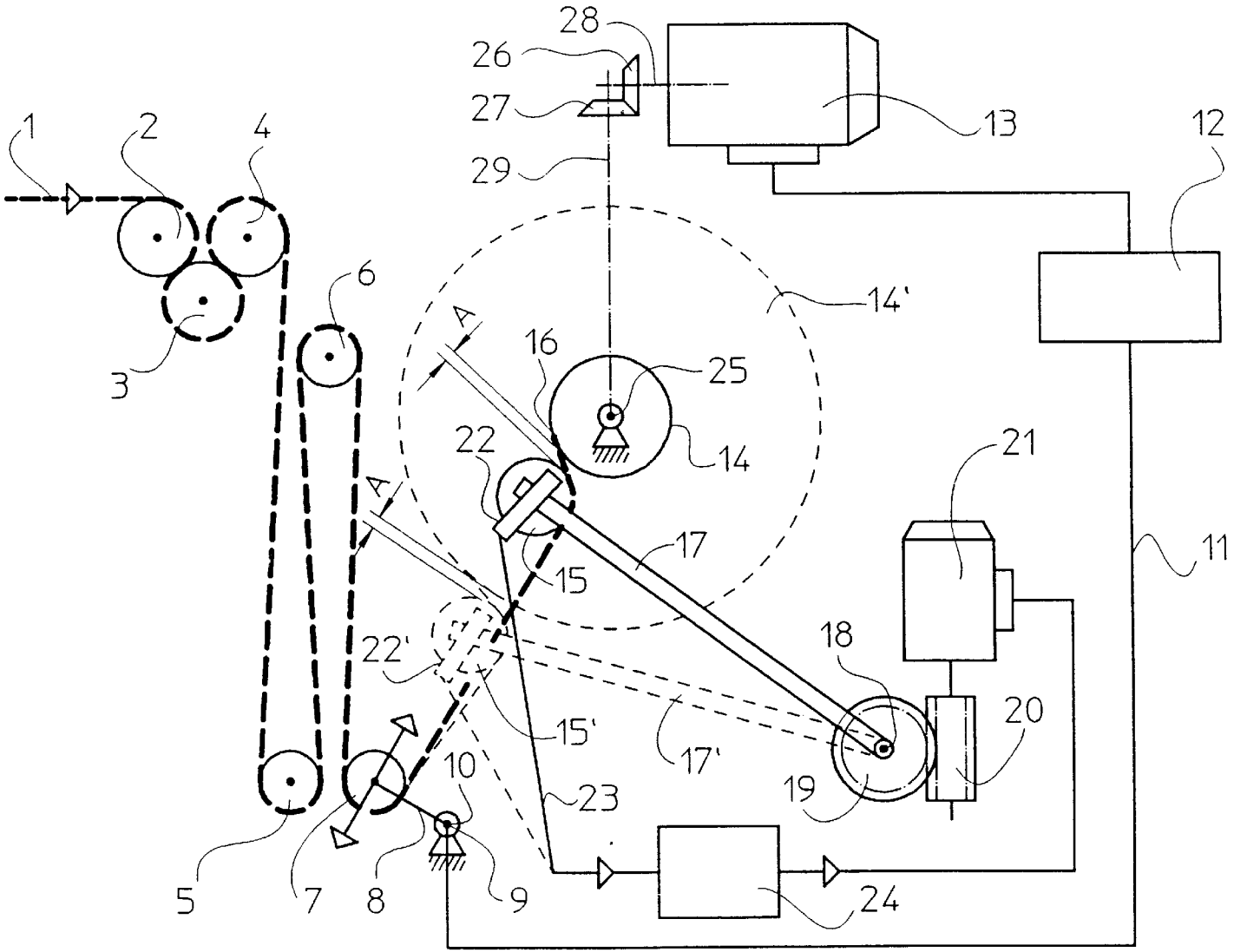
FIG. 1 shows the overall device in a basic illustration with a shiftable spreader roller.

According to FIG. 1, the knitted material web 1 (shown in dashed lines) is in a known manner being delivered from a warp knitting machine (not shown) and initially surrounds three pull down rollers 2, 3 and 4 which, because of their intimate contact therewith and their rotational speeds, establish the desired speed of the material web. The material web thereafter encircles the three deviation rollers 5, 6 and 7 of which the roller 7 has been designed as a dancer roller. The deviation/dancer roller 7 is supported on a pivot arm which can rotate on shaft 9. The shaft 9 with its support 10 is a known angle indicator (not shown in detail) which in dependence from its angular rotation of the pivot arm 8 transmits a corresponding signal to the regulator 12 by way of line 11 which, in a known manner with a regulating magnitude, influences the drive motor 13 for the material roll which will be described in detail below. The deviation/dancer roller 7 acts with its weight on the material web 1 whose respective tension more or less elevates or lowers its position relative to the position shown in FIG. 1 which is represented by the double arrows leading through the roller 7. The pivot arm 8 can also be biased by an adjustable spring to thereby obtain a predetermined and desired tension in the material web. When the roller pivots upwardly, this means an increase in tension which is being answered by a slow down of drive motor 13 and, of course, the reverse is true. The regulating mechanism is well known.

From the roller 7, the material web 1 is guided to the spreader roller 15, which, as explained above, takes care, that by way of its surface structure and its relative high number of rotations, the material web 1 is spread sideways by the surface of the spreader roller so that in this location the material web is under a minimum of a lateral tension. The spreader roller 15 is held closely to the run-on site 16, that is, with the gap A, so that the rotations cannot directly have on effect on the material roll 1. Because of arranging the spreader roller 15 adjacent to the material roll 14, a very short path is obtained for the material web 1 between the spreader roller 15 and the run-on site 16 so that in this section of the material web 1, the web cannot materially shrink laterally in spite of still remaining tension forces in a lateral direction but there is no way that the edges of the material web 1 can curl inwardly.

The spreader roller 15 is supported on pivot arms 17, of which only one is shown, and they are rotatably supported on shafts 18. Connected to the pivot arms 17 is a worm gear 19 which in turn is driven by the worm 20 by the motor 21. Through a corresponding rotation of the worm 20 by way of motor 21, a corresponding pivoting movement of the pivot arms occurs and thereby, the position of the spreader roller 15 relative to the outer surface of the material roll is changed, whereby the gap A is held at a constant.

The gap A between spreader roller 15 and the outer surface of the material roll 14 is adjusted in the following manner: On the corresponding end of one pivot arm 17 a distance sensor 22 is rigidly connected which can be, for example, an ultrasound transmitter and receiver, which in a known manner constantly signals its position under dependency from the distance between the sensor 22 and the outer surface of the material roll 14, if the sensor 22 and thereby the spreader roller 15 maintains a desired and predetermined distance relative to the outer surface of the material roll 14. By exceeding, respectively, minimizing the gap, the sensor 22 will send a corresponding signal over line 23 to the regulator 24 which according to the character of the signal causes the motor to execute a corresponding rotation, that is either left or right, to thereby readjust the pivot arm 17 so that the spreader roller 15 finds itself again at the desired gap A relative to the outer surface of the material roll 14. Again, a known regulating mechanism is used in this instance.

FIG. 1, still shows a different position of the pivot arms 17, which in this case have been referenced as 17' which is the position of a full material roll (referenced as 14'). Even in the position of 17' the spreader roller 15 maintains an exact gap A relative to the outer surface of the material roll 14'. During the movement of the pivot arms 17 to the position 17', the spreader roller undergoes an exact path of an arc of a circle which, however, has been stretched to such an extent that it resembles a linear movement under the conditions at hand so that the movement of the pivot arms in relation to the length of the material web 1 between the spreader roller 15 and the run-on site 16, practically, does not make any difference. Of course, the spreader roller can undergo a linear movement by being mounted on a slide guide.

The driving of the shaft 25 of the material roll 14/14' is bymotor 13 is accomplished over both bevel gears 26 and 27 and the dashed lines 28 and 29 connected to shaft 25, whereby, of course, for the correct mechanical connection, the motor 13 has to be in a position corresponding to the position of the shaft 25. The drive of the motor 13 is regulated, as explained above, by the regulator 12 which receives its signals from the position of the supports 9/10 of the deviation/dancer roller 7. With the aid of this regulator, one obtains the winding of the material roll under a constantly equal tension. The material roll 14/14' under the effect of the spreader roller 15 is thereby evenly wound into a cylindrical form. Because of the illustrated regulating mechanism including the regulator 24 and the ability to shift the spreader roller 15 by way of the pivot arms 17, there is practically, a constantly even position of the spreader roller relative to the prevailing run-on site 16. Thereby, an especially cylindrical winding of the material web onto to the material roll 14 is assured.

Figure 2:
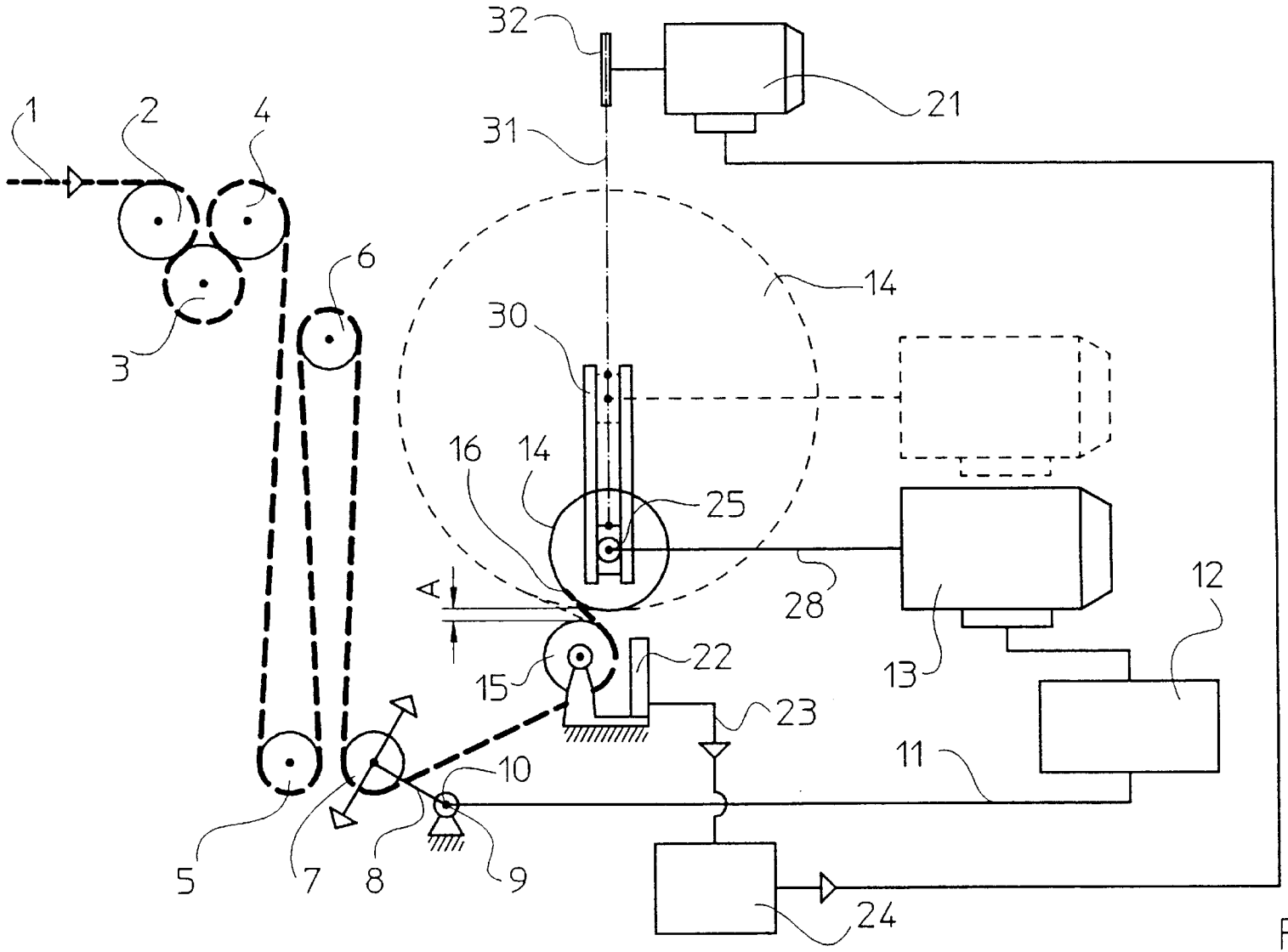
FIG. 2 shows the overall device in a basic illustration with a shiftable material roll.

FIG. 2 illustrates a device which corresponds to the structure of a relative shifting of the material roll relative to the spreader roller as illustrated in FIG. 1. Accordingly, the same reference characters are being used as they apply to FIG. 1. The device, as shown in FIG. 2, differs in illustrating a shiftable material roll 14/14'. The shifting is accomplished by a linear guide 30. The linear guide 30 is shown only in its basics because it is known in connection with such winding devices. The linear guide 30 makes it possible to elevate the material roll by way of its shaft, whereby the material roll 14 with its smallest diameter 14 (continuous line guide) is elevated into the position shown in dashed lines 14' and that is accomplished by a shifting of the shaft 25, whereby, with an increasing diameter of the material roll 14, the gap A between the material roll 14/14' and the spreader roller is kept essentially constant. The gap in this case, similar to the embodiment of FIG. 1, is obtained by means of a distance sensor 22 which is mounted on a holder on the spreader roller 15. The distance sensor sends a distance signal to the regulator 24 by way of line 23 which, as explained in connection with FIG. 1, causes the motor 21 to undergo corresponding rotations which in turn rotates the chain wheel 32 which by way of its chain 31 more or less elevates the shaft 25 or lowers it. The regulated elevating or lowering of the material roll 14/14' caused by the distance sensor 22, causes the establishment of a constantly remaining gap A between the material roll 14/14' and the spreader roller 15 for the material web and only a very short path is available between the spreader roller (15) and the material roll 14/14' so that, as presented in FIG. 1, an even winding of a cylindrical material roll is assured.

Figure 3:
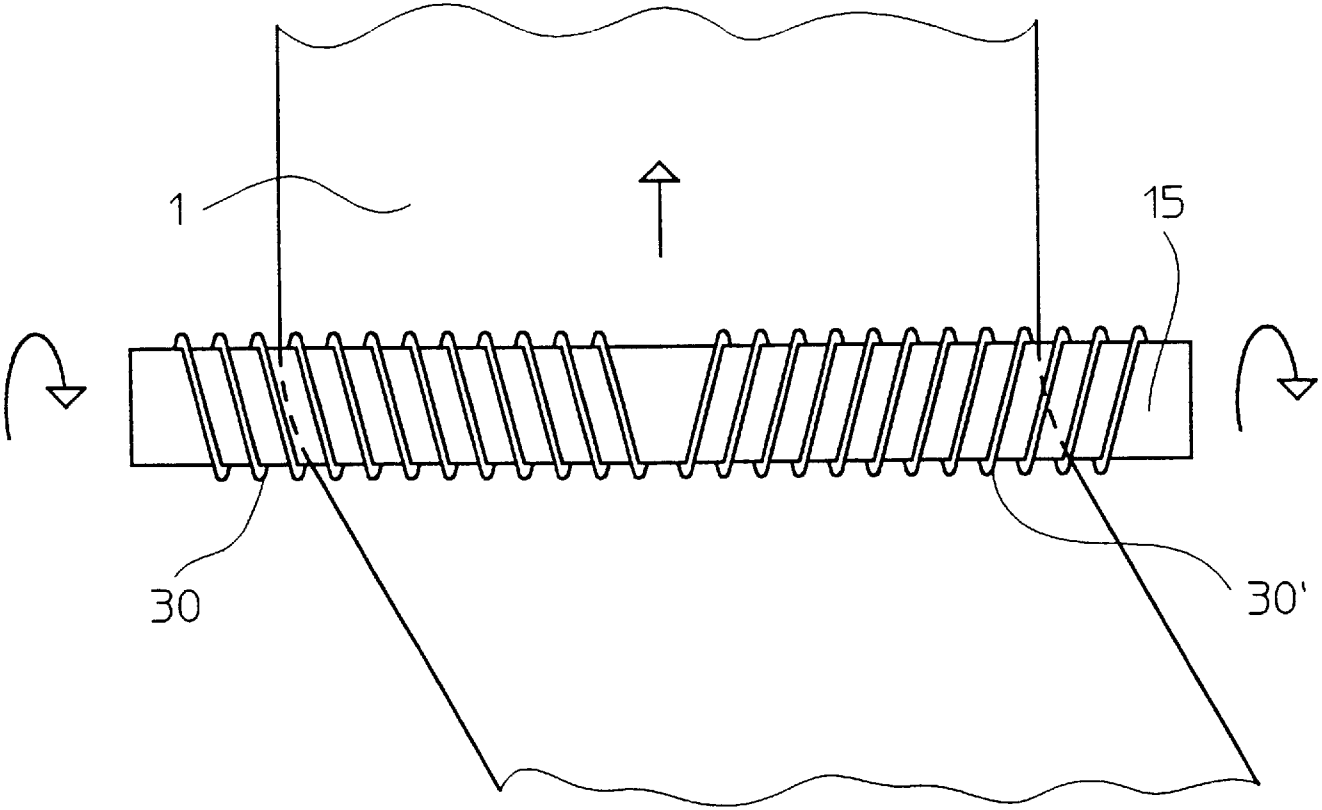
FIG. 3 shows the spreader roll in combination with a material web.

FIG. 3 shows the mode of operation of the spreader roller on the material web 1 which surrounds the spreader roller by about 90° . The continuous screw-like ribs 30 and 30' run outwardly to a certain extent when the spreader roller is rotating whereby they take care that a pulling force is exerted on the material web in a lateral direction so that incidental curls at the edges of the material web 1 are straightened out and a completely stretched flat material web 1 leaves the contact line at the spreader roller 15.

What is claimed is:

1. Device for winding up a knitted material web which is being delivered from a warp knitting machine to a material roll by way of a shaft drive.

wherein the rotational speed of the shaft drive is regulated in response to a sensor which senses the tension of the material web;

and wherein spreader roller is arranged adjacent to the material roll and maintained an approximately constant distance from the material roll by shifting the spreader roller along a radial guide;

and wherein the spreader roller is driven by a drive means such that the spreader roller maintains a rotational speed which substantially exceeds the delivery speed of the web.

2. Device according to claim 1, wherein the spreader roller is guided radially outwardly as the cross-sectional diameter of the material roll increases.

3. Device according to claim 1, wherein the material roll is guided away the from the spreader roller as the cross-sectional diameter of the material roll increases.

4. Device according to claim 2, wherein the spreader roller is supported by a plurality of pivot arms, the lengths of said pivot arms being such that when the spreader roller is pivoting, the spreader roller undergoes a nearly straight radial movement relative to the material roll.

5. Device according to claim 3, wherein a shaft of the material roll is supported by a vertical linear guide disposed at a normal to an axis of the shaft.

6. Device according to claim 1, wherein the spreader roller is preceded by a plurality of deviation rollers which are monitored by a sensor, the function of said plurality of deviation rollers being to relax the tension of the web after multiple deviations.

7. Device according to claim 1, wherein the spreader roller is driven by a drive means such that the spreader roller maintains a circumferential speed equal to at least ten times the delivery speed of the material web.

* * * * *